US008713964B2

(12) United States Patent
Le Bihan et al.

(10) Patent No.: US 8,713,964 B2
(45) Date of Patent: May 6, 2014

(54) METHOD AND DEVICE FOR SEPARATING A GAS MIXTURE BY CRYOGENIC DISTILLATION

(75) Inventors: Nerve Le Bihan, Sucy-en-Brie (FR); Jean-Marc Peyron, Creteil (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 1321 days.

(21) Appl. No.: 12/520,112

(22) PCT Filed: Dec. 18, 2007

(86) PCT No.: PCT/FR2007/052552

§ 371 (c)(1),
(2), (4) Date: Jun. 19, 2009

(87) PCT Pub. No.: WO2008/084167

PCT Pub. Date: Jul. 17, 2008

(65) Prior Publication Data

US 2010/0011811 A1 Jan. 21, 2010

(30) Foreign Application Priority Data

Dec. 22, 2006 (FR) ..... 06 55924

(51) Int. Cl.
*F25J 1/00* (2006.01)
*F25J 3/00* (2006.01)

(52) U.S. Cl.
USPC ..... 62/648; 62/643; 62/641; 62/644; 62/617; 62/600

(58) Field of Classification Search
USPC ..... 62/617, 620, 640, 641, 644, 647, 645, 62/648
See application file for complete search history.

(56) References Cited

U.S. PATENT DOCUMENTS

| | | | | |
|---|---|---|---|---|
| 5,406,800 | A * | 4/1995 | Bonaquist | 62/646 |
| 5,901,580 | A * | 5/1999 | Darredeau et al. | 62/656 |
| 6,073,463 | A | 6/2000 | Espie | |
| 6,351,968 | B1 | 3/2002 | Habicht et al. | |
| 6,351,971 | B1 * | 3/2002 | Nguyen et al. | 62/648 |
| 6,499,312 | B1 * | 12/2002 | Bergman et al. | 62/643 |
| 2002/0108377 | A1 | 8/2002 | Guillard | |

FOREIGN PATENT DOCUMENTS

| | | |
|---|---|---|
| FR | 2849172 | 6/2004 |
| FR | 2896860 | 8/2007 |

OTHER PUBLICATIONS

Search Report for PCT/FR2007/052552.

* cited by examiner

*Primary Examiner* — Brandon M Rosati
*Assistant Examiner* — Jon T Schermerhorn
(74) *Attorney, Agent, or Firm* — Justin K. Murray; Elwood L. Haynes

(57) ABSTRACT

The invention relates to a cryogenic distillation apparatus for a gas mixture, including a purification apparatus for purifying a gas mixture in a system with a plurality of adsorbant bottles, a column system, a capacity, means for feeding a cryogenic liquid to the capacity, means for feeding a vaporized liquid from the capacity to a column of the system, a vaporizer in the capacity for vaporizing the contained liquid; means for feeding a calorigenic gas to the vaporizer, and means for drawing a liquid from the capacity.

14 Claims, 1 Drawing Sheet

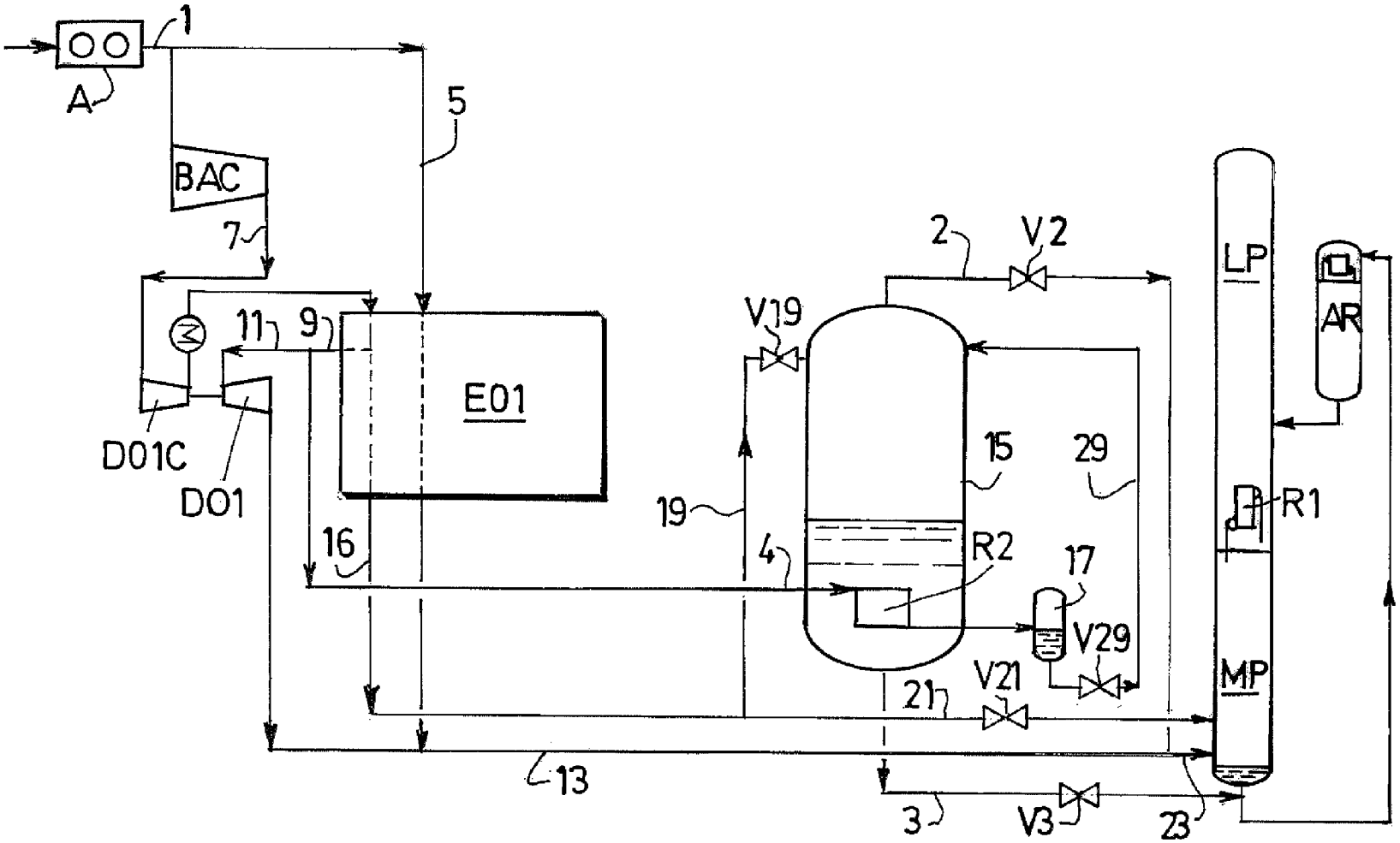
AR
LP
R1
MP
23
29
V29
17
V2
V3
15
R2
V21
2
21
3
V19
4
19
13
E01
5
16
9
11
7
BAC
M
D01
D01C
1
A

METHOD AND DEVICE FOR SEPARATING A GAS MIXTURE BY CRYOGENIC DISTILLATION

This application is a §371 of International PCT Application PCT/FR2007/052552, filed Dec. 18, 2007.

FIELD OF THE INVENTION

The present invention relates to a method and device for separating a gas mixture by cryogenic distillation, in particular to a method and device for separating air by cryogenic distillation.

SUMMARY OF THE INVENTION

The two bottles for the purification of the gas mixture intended for a cryogenic separation device operate in a cyclic manner between high-pressure adsorption phases and low-pressure regeneration phases. The transition between regeneration and adsorption therefore requires a pressurization of the bottle with feed gas from the cold box. This additional flow must be supplied by the main air compressor for air separation units. This therefore makes it necessary to size this compressor for the nominal flow increased by this bottle pressurization flow.

For air separation units without the production of argon, it may be accepted that the pressurization of the bottles is carried out to the detriment of the feed flow from the cold box without significant stability problems for the columns.

For separation units with argon production, the flow disturbance is too severe not to specify the compressor without this additional flow.

It is known to compensate for the reduction in the airflow by regulating the flows of reflux liquid (U.S. Pat. No. 6,073,463).

The device according to the present invention may compensate for the lack of flow injected into the columns without specification of additional flow on the main air compressor. This allows a reduction in the cost of the machine, a greater flexibility and a better energy optimization of the machine.

The system is composed of a cryogenic liquid tank with a bottom reboiler.

A tank is a vessel that does not contain any plates or packing.

A cryogenic liquid is a liquid at a temperature below 200 K.

According to one subject of the invention, a device is provided for the cryogenic distillation of a gas mixture comprising a purification unit for purifying the gas mixture in a system based on several bottles of adsorbent, operating according to a cycle comprising a pressurization phase, a system of columns, a tank, means for sending a cryogenic liquid to the tank solely outside of a pressurization phase, preferably any pressurization phase, means for sending vaporized liquid from the tank to a column of the system solely during at least one part of the period in which one of the bottles is in a pressurization phase, a reboiler in the tank to vaporize the liquid contained therein, means for sending a warming gas to the reboiler and means for withdrawing liquid from the tank.

According to other aspects of the invention:

- the cryogenic liquid is composed of a portion of the liquefied gas mixture and/or the warming gas is composed of a portion of the gas mixture;
- the device comprises means for sending the warming gas liquefied in the reboiler into the tank;

- a liquid is sent from the tank to a (the) column of the column system.

According to another subject of the invention, a method is provided for the cryogenic distillation of a gas mixture in a device according to one of the device claims, in which, solely during at least one part of the period in which one of the bottles is in a pressurization phase, a gas is sent from the tank to a column of the column system and solely outside of a, preferably any, pressurization period, the tank is filled with liquid.

According to other features of the invention:

- outside of a pressurization period, at least one portion of the gas mixture is condensed in a bottom reboiler of the tank and optionally the liquefied gas mixture is sent to the tank;
- the gas mixture is air;
- the column system comprises at least one double column with a medium-pressure column and a low-pressure column that are thermally coupled to one another and in which, during at least one part of the period in which one of the bottles is in a pressurization phase, air from the tank is sent to the medium-pressure column;
- air is sent from the tank to the medium-pressure column until the pressure of the tank reaches the pressure of the medium-pressure column;
- a gas is sent from the tank to a column of the column system solely during the period in which one of the bottles is in a pressurization phase;
- the maximum pressure of the tank is between 15 and 40 bar, preferably between 20 and 30 bar and/or the minimum pressure is between 4 and 10 bar.

DESCRIPTION OF THE FIGURES

The invention will be described in greater detail by referring to the FIGURE which illustrates an air separation device according to the invention.

DETAILED DESCRIPTION OF THE INVENTION

For a further understanding of the nature and objects for the present invention, reference should be made to the detailed description, taken in conjunction with the accompanying drawing, in which like elements are given the same or analogous reference numbers and wherein:

The air separation device comprises a conventional double column composed of three columns, a medium-pressure column MP and a low-pressure column LP, the two being thermally coupled to one another by a reboiler R1, and an argon column AR. The reflux lines between the two columns are well known in the art and will not be described or illustrated.

The device also comprises a tank 15, a phase separator 17 and a main exchange line 5. The subcoolers have not be illustrated.

The device produces, from the low-pressure column, an oxygen-rich stream and a nitrogen-rich stream, one and/or the other serving as the end product in liquid and/or gas form.

Air 1 purified in a purification unit A comprising bottles of adsorbent was compressed to a pressure slightly above that of the medium-pressure column MP.

This air is divided into two portions 5, 7. The portion 5 at a pressure slightly above that of the medium-pressure column MP is cooled in the exchange line E01 and is sent in gas form to the medium-pressure column MP.

The portion 7 is boosted in a booster BAC to an intermediate pressure and then boosted again in a booster D01C driven by the turbine D01.

The stream 7 is thus at a high pressure, is cooled and sent to the hot end of the exchange line E01 where it is partially cooled before being continuously divided into two fractions 11, 16, or even into three fractions 4, 11, 16, just before and/or during the filling phase. The fraction 11 is expanded in the turbine D01 in order to provide most of the refrigeration necessary for the device. Expanded to medium pressure, the fraction 11 rejoins the fraction 5 to form the stream 13 which is sent to the medium-pressure column MP.

The fraction 16 continues its cooling in the exchange line E01 as far as the cold end, optionally providing refrigeration for the vaporization of a liquid produced by the double column (not illustrated). Outside of the phase of filling the tank, all the liquefied air thus formed is sent through the valve V21 to the medium-pressure column as stream 21. Obviously, the stream 13 may be divided and sent to the two columns.

There are at least two operating phases in the method according to the invention:

According to a first phase, the tank 15 contains liquefied air at a high pressure (for example 25 bar abs) at its boiling point. When the pressurization of the bottles from the purification unit A begins, in order to then last around 6 minutes, the circuit 2 is opened by opening the valve V2 in order to supply the medium-pressure column MP with gaseous air so as to compensate for the reduction in the feed stream for the columns as a portion of the stream is required for the pressurization of the bottles. The pressure in the tank 15 decreases with vaporization of liquid, the heat required being provided by the subcooling of all of the available liquid in the tank. The pressure of the tank 15 decreases to the pressure of the medium-pressure column MP. The amount of liquid vaporized in and supplied to the medium-pressure column corresponds to the amount of gas required to pressurize the purification bottle. In the end, the remaining liquid is at the boiling point and at the pressure of the medium-pressure column MP.

During this phase, the valves V19, V29 are closed and the tank 15 is not supplied with air.

A purge circuit 3 ensures the continuous dilution of the impurities of the tank through the valve V3 which sends the purge to the rich bottoms liquid coming from the medium-pressure column MP.

According to a second phase, during the regeneration of the bottles (which lasts around 140 minutes): the filling of the tank 15 is carried out, hotter air 16 at the inlet of a turbine D01 at a pressure above the final high pressure of the tank is taken and condensed in the tank 15, by virtue of the bottom reboiler R2, the liquid from the tank being colder than the air at the inlet of the turbine D01. This makes it possible to increase the pressure of the tank to 25 bar and to fill the tank 15 with liquid. The system stops naturally when the temperature of the liquid of the tank 15 is close to the temperature at the inlet of the turbine D01. A small additional amount of liquid air (circuit 4) is produced by liquefying air in the reboiler R2. This liquid is then sent to a phase separator 17 and the liquid is sent via the line 29 through the valve V29 to the top of the tank 15 in order to top up the level of the tank, this liquid, coming from the reboiler R2, being colder than the liquid in the tank. The bottom reboiler R2 will ensure that this liquid is at the equilibrium temperature. During this phase, the valve V2 A purge circuit 3 ensures continuous dilution of the impurities of the tank through the valve V3 which sends the purge to the rich bottom liquid coming from the medium-pressure column MP. This rich liquid is then vaporized in the overhead condenser of the argon column AR.

This filling phase may be carried out by directly filling with high-pressure liquid air 16, 9 coming from the cold end of the main exchanger E01 as illustrated, or by taking a fluid from an intermediate point in the main exchanger in order to have a good equilibrium temperature of the final pressure of the tank, or a subcooled fluid (it will then be reheated by a bottom exchanger as described previously).

This device may also be applied to the cold boxes for separation by distillation of a mixture having, as main components, hydrogen and carbon monoxide. In order to compensate for the drops in carbon monoxide content during the purification inversions, it is possible to release a stream of carbon monoxide to the suction port of the carbon monoxide compressor or release the syngas stream in order to stabilize the gas supplies for the column for separating carbon monoxide and methane.

As the tank remains inside the cold box, the risk of spreading liquid carbon monoxide is eliminated.

Generally, the invention may be applied to any cryogenic cold box preceded by a purification in order to stabilize any cold stream supplying or produced by the cryogenic columns.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for the cryogenic distillation of a gas mixture in a device comprising a purification unit configured to purify the gas mixture in a system based on several bottles of adsorbent, wherein the purification unit operates according to a cycle comprising a pressurization phase system of columns, said system of columns comprising an MP column, a LP column, and an AR column, a tank configured to hold a cryogenic liquid, means for sending the cryogenic liquid to the tank solely outside of the pressurization phase, means for sending vaporized liquid from the tank to the MP column of the system solely during at least one part of a period in which one of the bottles is in the pressurization phase, a reboiler disposed in the tank, the reboiler configured to vaporize the cryogenic liquid contained within the tank, means for sending a warming gas to the reboiler, and means for withdrawing liquid from the tank, the method comprising the steps of:

introducing the gas mixture from the tank to the MP column solely during at least one part of the period in which one of the bottles of the purification unit is in the pressurization phase; and filling the tank with the cryogenic liquid solely outside of the pressurization phase, wherein the gas mixture is air.

2. The method of claim 1, in which, outside of a pressurization period, at least one portion of the gas mixture is condensed in a bottom reboiler of the tank.

3. The method of claim 1, in which the column system comprises at least one double column comprised of the MP column and an LP column that are thermally coupled to one another.

4. The method of claim 3, in which the air is sent from the tank to the MP column until the pressure of the tank reaches substantially the pressure of the MP column.

5. The method of claim 1, wherein the cryogenic liquid filling the tank has substantially the same composition as the gas mixture.

6. The method of claim 1, wherein the cryogenic liquid filling the tank is the gas mixture following liquefaction.

7. The method of claim 1, wherein the tank receives the gas mixture upstream the MP column.

8. The method of claim 1, wherein the step of filling the tank with the cryogenic liquid solely outside of the pressurization phase comprises filling the tank with the cryogenic liquid only when no pressurization phase is taking place.

9. The method of claim 1, wherein the method further comprises the absence of a step of sending a fluid from the MP column or LP column to the tank.

10. The method of claim 1, further comprising the step of withdrawing a liquid purge stream from a bottom portion of the tank.

11. A method for the cryogenic distillation of air in a device, the device comprising a purification unit configured to purify the air using a system having a plurality of bottles of adsorbent, wherein the purification unit operates according to a cycle comprising a pressurization phase and a regeneration phase; a system of columns, said system of columns comprising an MP column, an LP column, and an AR column; a tank configured to hold liquefied air, the tank being in fluid communication with the system of columns, the tank comprising a first liquefied air inlet configured to receive liquefied air, the tank further comprising an air vapor outlet configured to withdraw air vapor from the tank; a reboiler disposed in the tank, the reboiler configured to vaporize a portion of the liquefied air contained within the tank such that vaporized air forms in the head space of the tank; a heat exchanger in fluid communication with the purification unit such that the heat exchanger is configured to receive air from the purification unit, wherein the heat exchanger is in fluid communication with the liquefied air inlet of the tank and the reboiler, wherein the heat exchanger has a cold side, a warm side, and a intermediate point; a first valve configured to control the flow of liquefied air entering the tank from the heat exchanger, a second valve configured to control the flow of air entering the reboiler from the intermediate point of the heat exchanger, a third valve configured to control the flow of the air vapor traveling from the air vapor outlet of the tank to the system of columns, the method comprising the step of:

operating the device under a first phase and a second phase, wherein during the first phase, the method comprises the steps of:

pressurizing at least one bottle of adsorbent;

opening the third valve to allow for flow of the air vapor from the tank to the system of columns; and closing the first valve and the second valve such that liquefied air is not being fed to the tank;

wherein during the second phase, the method comprises the steps of:

an absence of pressurizing at least one bottle of adsorbent;

opening the first valve and the second valve such that liquefied air is fed to the tank; and closing the third valve to prevent flow of the air vapor from the tank to the system of columns.

12. The method of claim 11, wherein the tank further comprises a second liquefied air inlet configured to receive liquefied air from the reboiler, wherein the second liquefied air inlet is in fluid communication with the second valve.

13. The method of claim 11, wherein the method further comprises the absence of a step of sending a fluid from the MP column or LP column to the tank.

14. The method of claim 11, wherein column system comprises at least one double column comprised of the MP column and an LP column that are thermally coupled to one another.

* * * * *

UNITED STATES PATENT AND TRADEMARK OFFICE

CERTIFICATE OF CORRECTION

PATENT NO. : 8,713,964 B2
APPLICATION NO. : 12/520112
DATED : May 6, 2014
INVENTOR(S) : Herve Le Bihan and Jean-Marc Peyron It is certified that error appears in the above-identified patent and that said Letters Patent is hereby corrected as shown below:

On the Title Page

Item (75) Inventors:

Change "Nerve Le Bihan," to -- Herve Le Bihan, --.

Signed and Sealed this
Thirtieth Day of September, 2014

Michelle K. Lee

Michelle K. Lee
*Deputy Director of the United States Patent and Trademark Office*